United States Patent [19]

Han

[11] Patent Number: 4,868,988

[45] Date of Patent: Sep. 26, 1989

[54] SELF HAIR CUTTING DEVICE

[76] Inventor: Xiaowen S. Han, 63 Federal Rd., Barrington, R.I. 02806

[21] Appl. No.: 261,761

[22] Filed: Oct. 14, 1988

Related U.S. Application Data

[63] Continuation-in-part of Ser. No. 78,891, Jul. 29, 1987.

[51] Int. Cl.[4] ..... B26B 19/02

[52] U.S. Cl. ..... 30/210; 30/214

[58] Field of Search ..... 30/195, 210, 208, 209, 30/214, 223

[56] References Cited

U.S. PATENT DOCUMENTS

| | | | |
|---|---|---|---|
| 2,717,443 | 9/1955 | Turbett | 30/210 |
| 2,827,695 | 3/1958 | Vitale | 30/210 |
| 2,883,747 | 4/1959 | Johnson et al. | 30/210 |
| 3,372,481 | 3/1968 | Skinner | 30/210 |

FOREIGN PATENT DOCUMENTS

| | | | |
|---|---|---|---|
| 255841 | 11/1926 | United Kingdom | 30/210 |

*Primary Examiner*—Frank T. Yost
*Assistant Examiner*—Michael D. Folkerts

[57] ABSTRACT

A self hair cutting or trimming device comprises an elongated handle housing an electric drive, the drive comprises an elongated spool mounted coil connected in series with a diode. An elongated core is mounted through the coil and connects a movable blade in sliding contact with a fixed blade projecting from the forward end of the handle. Within the backward end of the handle a plastic bolt is threadedly received to adjust the position of the core, and thereby the movable blade, through a spring disposed in between the bolt and the core.

2 Claims, 2 Drawing Sheets

SELF HAIR CUTTING DEVICE

This is a continuation-in-part of application Ser. No. 078,891, filed July 29, 1987.

This invention relates to a hair cutting device and particularly to a device which can be used to trim the hair of the operator of the device, that is, for do-it-yourself hair cutting. It also can be provided as a high-power, low-price professional hair cutting tool.

Although clippers in a variety of styles and designs have been develped for self hair cutting in the past, and proposed theoretical success, all of them have problems in practice. None of them has been successful for marketing. Thus, there remains a need to accomplish a new design for a self hair cutting device.

The major problems maintained by these clippers are the following:

1. The movable core of the electromagnetic drive of these clippers is disposed outside of the coil, and thus can not receive sufficient power from the magnetic field generated by the coil to move the blade efficiently.
2. The 60 Hz frequency that is usually functioning in the current is too fast to move the blade a sufficient distance.

Due to these two major problems, past self hair cutting inventions are impractical for cutting hair properly. Since hair is so strong, it requires a device powerful enough to cut through it. Thus, a new drive system of the cutting device has to be designed to meet this requirement.

It is therefore one object of the present invention to provide a hair cutting device with an electromagnetic drive which includes a longitudinal spool coil and a movable and adjustable core through the spool coil.

An additional object of the present invention is to provide a hair cutting device with an electrical frequency decrease system which increases the distance of the blade movement.

The objects, features, and advantages of the present invention will become apparent as the description thereof proceeds when considered in connection with the accompanying illustrative drawings.

Figure 1:
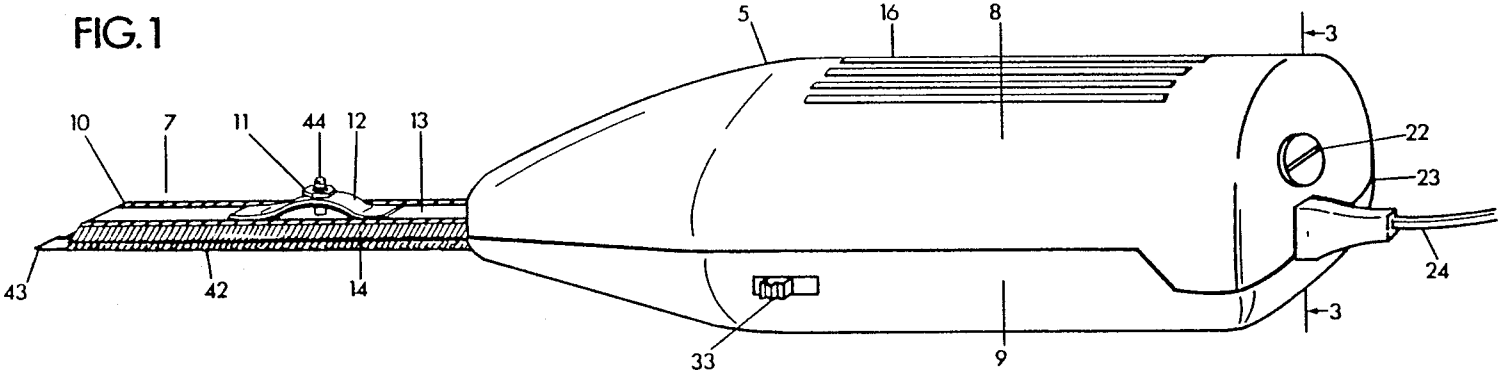
FIG. 1 is a perspective view showing the self hair cutting device of the present invention in its entirety.
Figure 2:
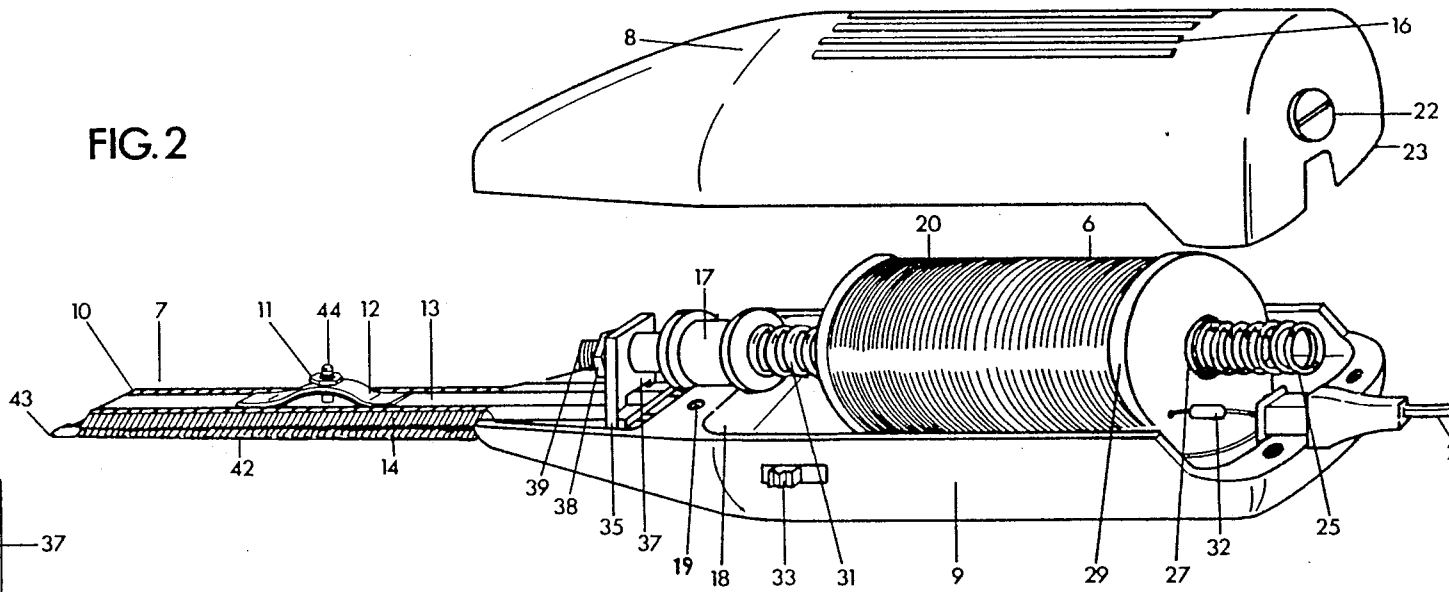
FIG. 2 is an exploded view showing the relative relationship of the parts.

Referring now to the drawing, and particularly to FIGS. 1 and 2, the self-hair cutting device is shown as comprising a cylindrical handle designated generally as (5), and a drive designated generally as (6), and a blade assembly designated generally as (7). The device may be connected to an AC source of electrical energy through a cord (24) for supply.

Referring now to FIG. 2, the cylindrical handle (5) includes a cover housing part (8) and a bottom housing part (9). The cover housing part (8) and the bottom housing part (9) can be fastened together by screws through the apertures (19) forming the entire handle (5) of the cutting device. A pair of collar holders (18) are mounted in each housing (8) and (9) respectively. A plastic bolt (22) is threadedly received within the backward end (23) of the top housing (8) for adjusting the position and extent of movement of a movable blade (10).

Figure 4:
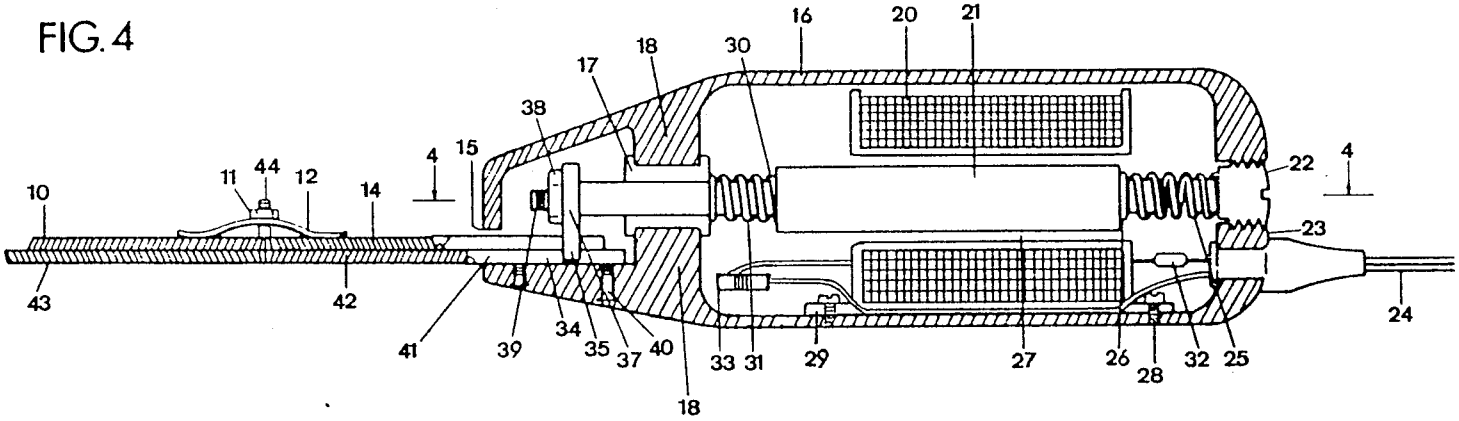
FIG. 4 is a longitudinal sectional view taken substantially through a plane indicated by section line 3—3 in FIG. 1.
Figure 5:
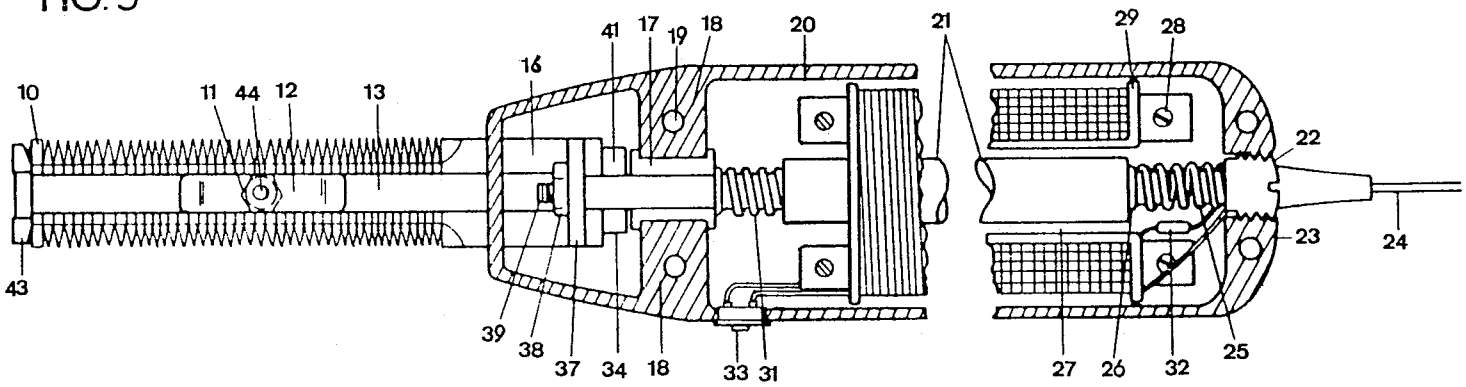
FIG. 5 is a longitudinal sectional view taken substantially through a plane indicated by section line 4—4 in FIG. 4.

Referring now to FIGS. 2, 4, and 5, the drive comprises a spool support element (29) mounted within the bottom housing (9) by screws (28), a coil (20) mounted on the spool support (29), and a core (21) slidably mounted by a collar (17) seated in the collar holders (18). The core (21) is disposed through the spool (27) separately. A spring (25) is disposed between the plastic bolt (22) and the flange (26) of the backward end of the core (21). Another spring (31) surrounding the core (21) is disposed between the collar (17) and the flange (30) of the forward end of the core (21).

A diode (32) is connected in series with the coil (20) and a switch (33) mounted on the bottom housing which is in the connection to the electrical cord (24) extending through the bottom housing (9).

The diode (32) acts to decrease the vibration frequency and thereby increase the movement distance of the movable blade (10).

The blade assembly (7) includes a longitudinally oriented fixed blade (43), a longitudinal movable blade (10) a nd a belt-shaped spring (12).

The fixed blade (43) includes two lines of longitudinally spaced cutting teeth (42) and a handle portion (41) extending into a slot (15) presented in the forward end of the bottom housing. The handle portion (41) is longitudinally mounted to the forward end of the bottom housing (9) by a pair of fasteners (40). The movable blade (10) includes two lines of longitudinally spaced cutting teeth (14) and a handle portion (16). The movable blade (10) and the fixed blade (43) are formed as integral portions by a bolt (44) with a nut (11). A belt-shaped spring (12) is disposed between the nut (11) and the movable blade (10). A longitudinal groove (13) is formed on the upside of the movable blade (10), seated in which the belt-shaped spring (12) functions as a guide for guiding the movable blade movement.

The handle (16) of the movable blade (10) extending into the slot (15) is connected to the core (21) by a transmission element (37) vertically mounted on the threaded end (39) of the core (21) by a nut (38) for longitudinal reciprocation.

Figure 3:
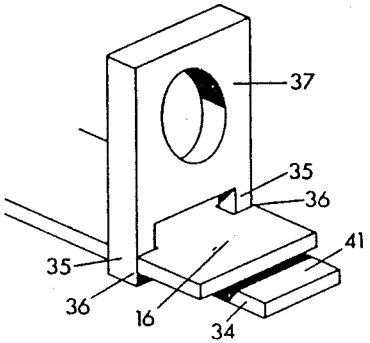
FIG. 3 is an exploded view showing the relative relationship between the blades and the transmission designated as (37).

Referring now to FIG. 3, two projections (35) of the transmission (37) are disposed within the two notches (36) of the movable blade handle (16), and are slidably disposed beside two edges (34) of the fixed blade handle (41) in order to be guided during reciprocation.

Accordingly, the objects of the present invention are accomplished in the intended manner by a device which is relatively low cost and easy to manufacture and thus available for mass marketing.

The invention claimed is:

1. A hair cutting device comprising: an elongated spool coil fixedly mounted within an elongated housing, said housing divided into a cover housing and a bottom housing; a core separately disposed through said spool coil, slidably mounted by a collar, said collar stably mounted in a pair of collar holders, said collar holders respectively mounted within said cover housing and said bottom housing; a spring surrounding said core, disposed between said collar and a flange of said core; a plastic threadedly received within the backward end of said housing; another spring connecting the back end of said core and said plastic bolt; a fixed blade screwed to the forward end of said housing, a movable blade tightened to said fixed blade by a belt-shaped spring; guide means (a) mounted on said movable blade for guiding the movement of said movable blade, said guide means (a) comprising a groove on said movable blade, and said belt-shaped spring seated within said groove; a transmission element connecting said core and said movable blade for reciprocation transmission; a second guide means (b) projected from said transmission element for guiding movement of said movable blade, said second guide means (b) comprising a pair of projections projected from said transmission element, and said fixed blade having two longitudinal edges in sliding contact with said projections respectively; and wherein said plastic bolt forms an adjustment means for adjusting the position and the movement extent of said movable blade.

2. A hair cutting device as defined in claim 1 wherein a diode is connected in series with said coil for decreasing the vibration frequency of the movable blade and increasing the movement distance of the movable blade.

* * * * *